US007813658B2

(12) United States Patent
Hamaya et al.

(10) Patent No.: US 7,813,658 B2
(45) Date of Patent: Oct. 12, 2010

(54) IMAGE FORMING APPARATUS

(75) Inventors: Masahito Hamaya, Nagoya (JP); Hiroyuki Naganawa, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

(21) Appl. No.: 12/023,088

(22) Filed: Jan. 31, 2008

(65) Prior Publication Data

US 2008/0181656 A1 Jul. 31, 2008

(30) Foreign Application Priority Data

Jan. 31, 2007 (JP) ..... 2007-021773

(51) Int. Cl.
*G03G 15/02* (2006.01)

(52) U.S. Cl. ..... 399/31

(58) Field of Classification Search ..... 399/24, 399/31, 50, 100, 170, 311
See application file for complete search history.

(56) References Cited

U.S. PATENT DOCUMENTS

| | | | | |
|---|---|---|---|---|
| 3,727,113 | A * | 4/1973 | Weber | 361/230 |
| 6,115,560 | A * | 9/2000 | Kuek et al. | 399/45 |
| 2004/0041897 | A1* | 3/2004 | Chino et al. | 347/153 |
| 2008/0050135 | A1* | 2/2008 | Kawabata | 399/50 |

FOREIGN PATENT DOCUMENTS

| | | | |
|---|---|---|---|
| JP | 1-261676 | A | 10/1989 |
| JP | 05-033158 | | 4/1993 |
| JP | 9-15946 | A | 1/1997 |
| JP | 11-258959 | | 9/1999 |
| JP | 2002-189336 | A | 7/2002 |
| JP | 2004-233626 | | 8/2004 |
| JP | 2005-37552 | A | 2/2005 |

OTHER PUBLICATIONS

JP Office Action dtd Sep. 2, 2008, JP Appln. 2007-021773.

* cited by examiner

*Primary Examiner*—David P Porta
*Assistant Examiner*—Kiho Kim
(74) *Attorney, Agent, or Firm*—Banner & Witcoff, Ltd.

(57) ABSTRACT

An image forming apparatus is provided. The image forming apparatus includes a photosensitive member which carries an electrostatic latent image; a charger comprising a charging wire extended in a direction parallel to an axial direction of the photosensitive member, the charger serving to charge the photosensitive member, and a promoting unit which is provided on at least one side of a region of the charger which is opposite to an image forming region in which the electrostatic latent image is formed, the promoting unit promoting a leakage current of the charger; detecting unit which detects a leakage current of the charger; and a correction unit which corrects the charging wire if the leakage current is detected.

9 Claims, 12 Drawing Sheets

*EXAMPLE OF LEAKAGE DETECTING MODE*

EXAMPLE FLOW CHART

EXAMPLE OF LEAKAGE DETECTING MODE

EXAMPLE OF LEAKAGE DETECTING MODE

IMAGE FORMING APPARATUS

CROSS REFERENCE TO RELATED APPLICATION

The present application claims priority from Japanese Patent Application No. 2007-021773, which was filed on Jan. 31, 2007, the disclosure of which is herein incorporated by reference in its entirety.

TECHNICAL FIELD

Apparatuses consistent with the present invention relate to electro-photographic image forming apparatuses.

BACKGROUND

An electro-photographic image forming apparatus exposes a charged photosensitive drum to form an electrostatic latent image on a photosensitive member, electro-statically adsorbs a toner (a developer) into the exposed portion to form a toner image, and then transfers the toner image onto a recording sheet, thereby forming an image.

Moreover, as described in Japanese Publication JP-A-11-258959, a scorotron type charger for charging a photosensitive member is constituted by a charging wire extended in a parallel direction with an axial direction of a photosensitive drum and a grid electrode having a predetermined interval with the charging wire and disposed on the photosensitive member side. A high voltage is applied to the charging wire so that a stable corona discharge is generated and the photosensitive member is charged.

SUMMARY

However, the scorotron type charger described above has a number of disadvantages. First, often toner or dust floats around the charging wire. When a high voltage is applied to the charging wire, an electric field is generated, and over time, the floating dust and toner becomes stuck to the charging wire so that a wire thickening phenomenon occurs. As the wire thickening phenomenon progresses, the corona discharge is lessened so that the grid current is decreased.

It is possible to raise the voltage to be applied to the charging wire in order to maintain the grid current at a certain value. However, if the voltage to be applied to the charging wire is raised, a thickened portion of the charging wire having a small clearance from the grid electrode begins to break down. Consequently, a leakage current is generated from the charging wire to a side of the grid electrode.

The leakage current generates a similar state as a state in which the photosensitive drum is exposed. Thus, an accurate electrostatic latent image cannot be formed on the photosensitive drum, and thus, an accurate image cannot be formed on a recording sheet.

Accordingly, it is an object of the present invention to solve these disadvantages by suppressing a leakage which adversely influences an electrostatic latent image formed on a photosensitive member.

Illustrative aspects of the present invention address the above-described disadvantages and other disadvantages not described above. However, the present invention is not required to overcome the disadvantages described above, and thus, an illustrative aspect of the present invention may not overcome any of the problems described above.

According to a first illustrative aspect of the present invention, there is provided an image forming apparatus comprising a photosensitive member for carrying an electrostatic latent image, a charger having a charging wire extended in a parallel direction with an axial direction of the photosensitive member and serving to charge the photosensitive member, detecting unit for detecting a leakage current of the charger, and at least one of cleaning unit for cleaning the charging wire when the leakage current is detected by the detecting unit and exchanging unit for exchanging the charging wire when the leakage current is detected by the detecting unit, the charger having promoting unit for promoting a leakage of the charger, and the promoting unit being provided in a place other than an opposite position to an image forming region in which the electrostatic latent image is formed.

According to a second illustrative aspect of the present invention, there is provided an image forming apparatus comprising a photosensitive member for carrying an electrostatic latent image, a charger having a charging wire extended in a parallel direction with an axial direction of the photosensitive member and serving to charge the photosensitive member, detecting unit for detecting a leakage current of the charger, and alarm unit for giving an alarm indicative of a purport that the charging wire is to be cleaned or exchanged when the leakage current is detected by the detecting unit, the charger having promoting unit for promoting a leakage of the charger, and the promoting unit being provided in a place other than an opposite position to an image forming region in which the electrostatic latent image is formed.

BRIEF DESCRIPTION OF THE DRAWINGS

Exemplary embodiments of the invention will be described in detail with reference to the following figures wherein.

DETAILED DESCRIPTION OF EXEMPLARY EMBODIMENTS OF THE PRESENT INVENTION

First Exemplary Embodiment

1. Structure of Image Forming Apparatus

Figure 1:
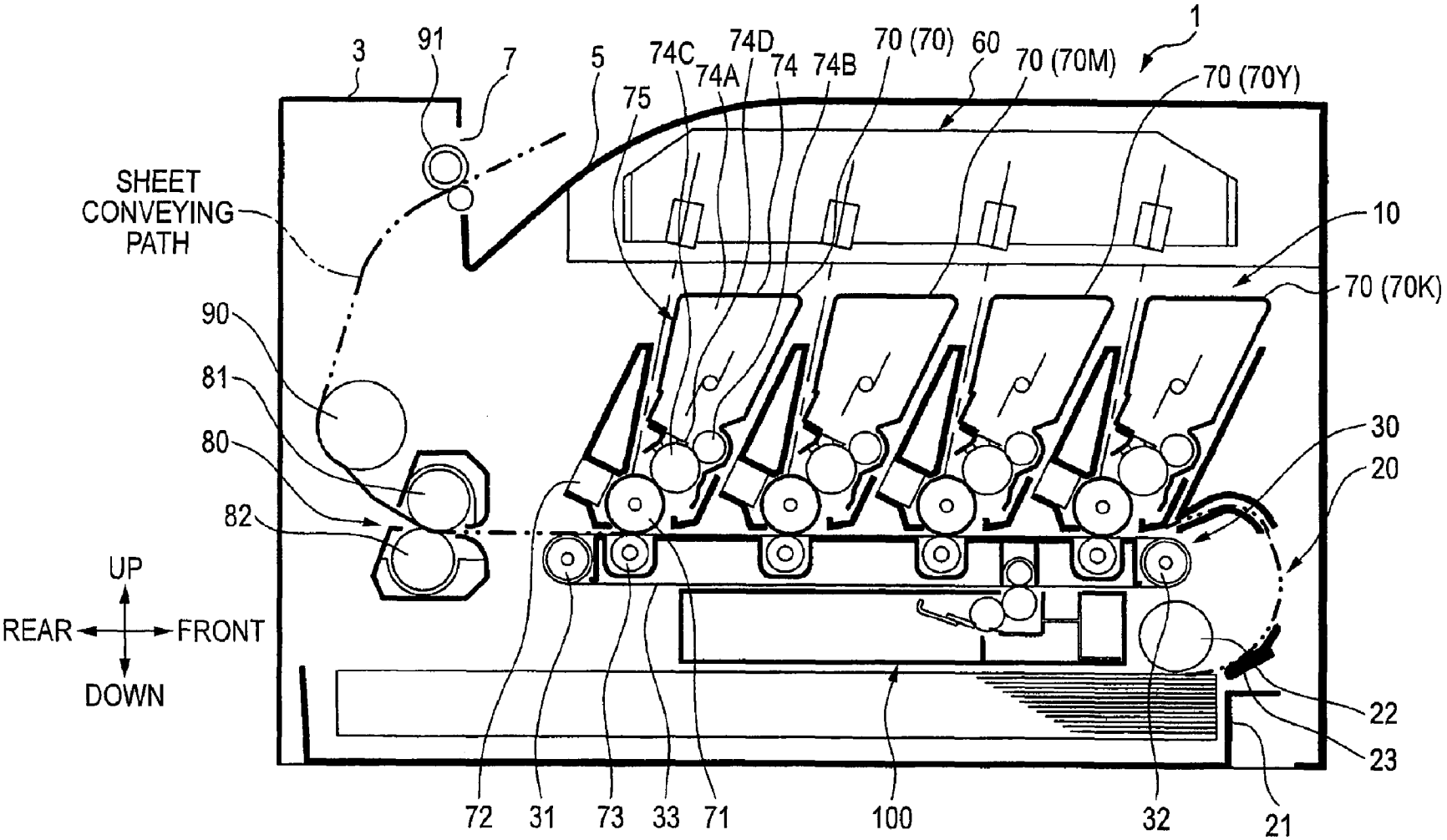
FIG. 1 is a sectional side view showing a part of an image forming apparatus according to a first exemplary embodiment of the present invention.
Figure 2:
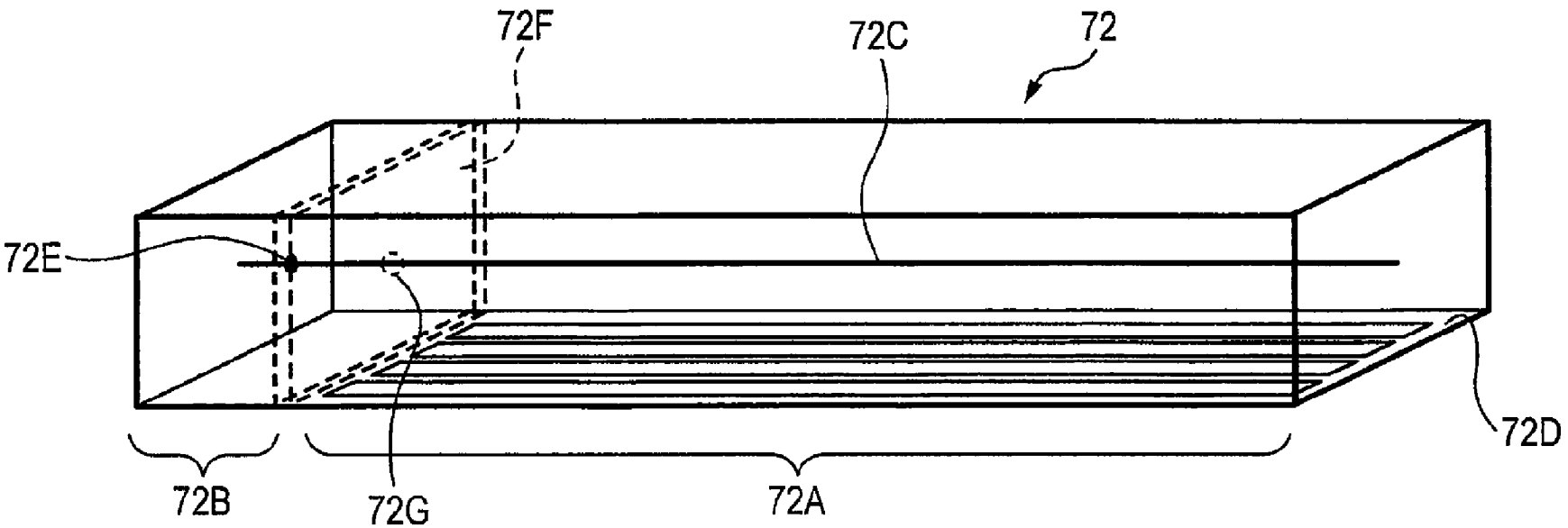
FIG. 2 is a typical view showing a structure of a charger according to the first exemplary embodiment of the present invention.

FIG. 1 is a sectional side view showing a part of an image forming apparatus according to a first exemplary embodiment of the present invention. FIG. 2 is a view showing a structure of a charger of the image forming apparatus of FIG. 1.

The image forming apparatus 1 is disposed with an upper side of a sheet set to be an upper side in a direction of a gravity and is usually used with a right side of the sheet set to be a front side in FIG. 1. An upper surface side of a housing 3 of the image forming apparatus 1 is provided with a sheet discharging tray 5 on which a sheet or an OHP sheet (herein after referred to as a sheet) to be discharged from the housing 3 after printing is mounted.

A frame member formed of metal or resin is provided on an inside of the housing 3, and a developing cartridge 70 and a fixing unit 80 which will be described below are removably assembled into the frame member (not shown) provided on the inside of the housing 3.

2. Outline of Internal Structure of the Image Forming Apparatus

An image forming portion 10 forms an image on a sheet. A feeder portion 20 feeds the sheet to the image forming portion 10. A conveying mechanism 30 conveys the sheet to four developing cartridges 70K, 70Y, 70M and 70C comprising the image forming portion 10.

After a conveying direction of the sheet having the image formed thereon in the image forming portion 10 is changed into an upper side through an intermediate conveying roller 90, it is discharged from a discharging portion 7 to the sheet discharging tray 5 by means of a discharge roller 91.

2. 1. Feeder Portion

The feeder portion 20 comprises a sheet feeding tray 21 accommodated in a lowermost part of the housing 3, a feed roller 22 provided above a front end of the sheet feeding tray 21 and serving to feed (convey) the sheet mounted on the sheet feeding tray 21 to the image forming portion 10, and a separating pad 23 for applying a conveying resistance (which may be predetermined) to the sheet, thereby separating the sheets conveyed by means of the feed roller 22 one by one.

The sheet mounted on the sheet feeding tray 21 is conveyed to the image forming portion 10 provided in an almost central part in the housing 3 so as to make a U turn at a forward side in the housing 3.

2. 2. Conveying Mechanism

The conveying mechanism 30 comprises a driving roller 31 to be rotated interlockingly with an operation of the image forming portion 10, a driven roller 32 provided rotatably in a position placed separately from the driving roller 31, and a conveying belt 33 wound between the driving roller 31 and the driven roller 32.

When the conveying belt 33 is rotated with the sheet mounted thereon, the sheet conveyed from the sheet feeding tray 21 is sequentially conveyed to the four developing cartridges 70K, 70Y, 70M and 70C.

Moreover, a belt cleaner 100 is a cleaning means for removing a toner stuck to a surface of the conveying belt 33. The belt cleaner 100 is removably assembled to the frame member.

2. 3. Image Forming Portion

The image forming portion 10 comprises a scanner portion 60, the developing cartridge 70 and the fixing unit 80.

The image forming portion 10 according to the first exemplary embodiment is of a direct tandem type capable of carrying out a color print. In the first exemplary embodiment of the present invention, the four developing cartridges 70K, 70Y, 70M and 70C corresponding to toners (developers) having four colors of black, yellow, magenta and cyan, respectively, are arranged in series in the conveying direction of the sheet from an upstream side in the conveying direction of the sheet.

2. 3. 1. Scanner Portion

The scanner portion 60 is provided on an upper part in the housing 3 and serves to form an electrostatic latent image on a surface of a photosensitive drum 71 provided in each of the four developing cartridges 70K, 70Y, 70M and 70C, and specifically comprises a laser beam source, a polygon mirror, an fθ lens and a reflecting mirror.

A laser beam emitted from a laser beam source based on image data is deflected by the polygon mirror and passes through the fθ lens, and an optical path is then folded back by means of the reflecting mirror and is thereafter bent downward by means of the reflecting mirror so that the laser beam is irradiated onto the surface of the photosensitive drum 71 and an electrostatic latent image is thus formed.

2. 3. 2. Developing Cartridge

The four developing cartridges 70K, 70Y, 70M and 70C have different toner colors but otherwise their structures are the same. Therefore, a structure of the developing cartridge 70C will be described below as an example. The four developing cartridges 70K, 70Y, 70M and 70C will be generally referred to as the developing cartridge 70.

The developing cartridge 70 is removably disposed in the housing 3 at a lower side of the scanner portion 60 and comprises a casing 75 for accommodating the photosensitive drum 71, a charger 72 and a toner housing portion 74.

A transfer roller 73 is rotatably supported on the frame member at an opposite side to the photosensitive drum 71 with the conveying belt 33 interposed there between.

The photosensitive drum 71 is a photosensitive member for carrying an electrostatic latent image to be transferred onto the sheet. The photosensitive drum 71 according to the first exemplary embodiment has a most surface layer which is formed by a photosensitive layer comprising polycarbonate and having a positive charging property and takes a cylindrical shape.

The charger 72 charges the surface of the photosensitive drum 71. The charger 72 is disposed opposite to the photosensitive drum 71 at an interval so as not to come in contact with the photosensitive drum 71 obliquely above a rear side of the photosensitive drum 71. The interval may be predetermined. The detailed structure of the charger 72 according to the first exemplary embodiment of the present invention will be described below.

In FIG. 1, the transfer roller 73 serves as transfer means which is disposed opposite to the photosensitive drum 71, and is rotated interlockingly with the rotation of the conveying belt 33 and causes an opposite charge (a negative charge in the first exemplary embodiment) to a charge applied to the photosensitive drum 71 to act on the sheet at an opposite side to a print surface when the sheet passes through the vicinity of the photosensitive drum 71, thereby transferring a toner stuck to the surface of the photosensitive drum 71 onto a print surface of the sheet.

The toner housing portion 74 comprises a toner housing chamber 74A accommodating the toner therein, a toner feeding roller 74B for feeding the toner to the photosensitive drum 71, and a developing roller 74C.

The toner accommodated in the toner housing chamber 74A is fed to the developing roller 74C side by a rotation of the toner feeding roller 74B, and furthermore, the toner fed to the developing roller 74C side is carried on a surface of the developing roller 74C and a thickness of the toner carried on a thickness regulating blade 74D is regulated to be constant (uniform) in a threshold thickness (which may be predetermined), and the toner is then fed to the surface of the photosensitive drum 71 exposed through the scanner portion 60.

2. 3. 3. Fixing Unit

The fixing unit 80 is disposed at a rear stream side of the photosensitive drum 71 in a sheet conveying direction and serves to heat, melt and fix the toner transferred onto the sheet. The fixing unit 80 is removably assembled into the frame member.

More specifically, the fixing unit 80 comprises a heating roller 81 which is disposed on a print surface side of the sheet and serves to apply a conveying force to the sheet while heating the toner, and a pressing roller 82 which is disposed on an opposite side to the heating roller 81 with the sheet interposed there between and serves to press the sheet against the heating roller 81 side.

2. 3. 4. Charger

Figure 3:
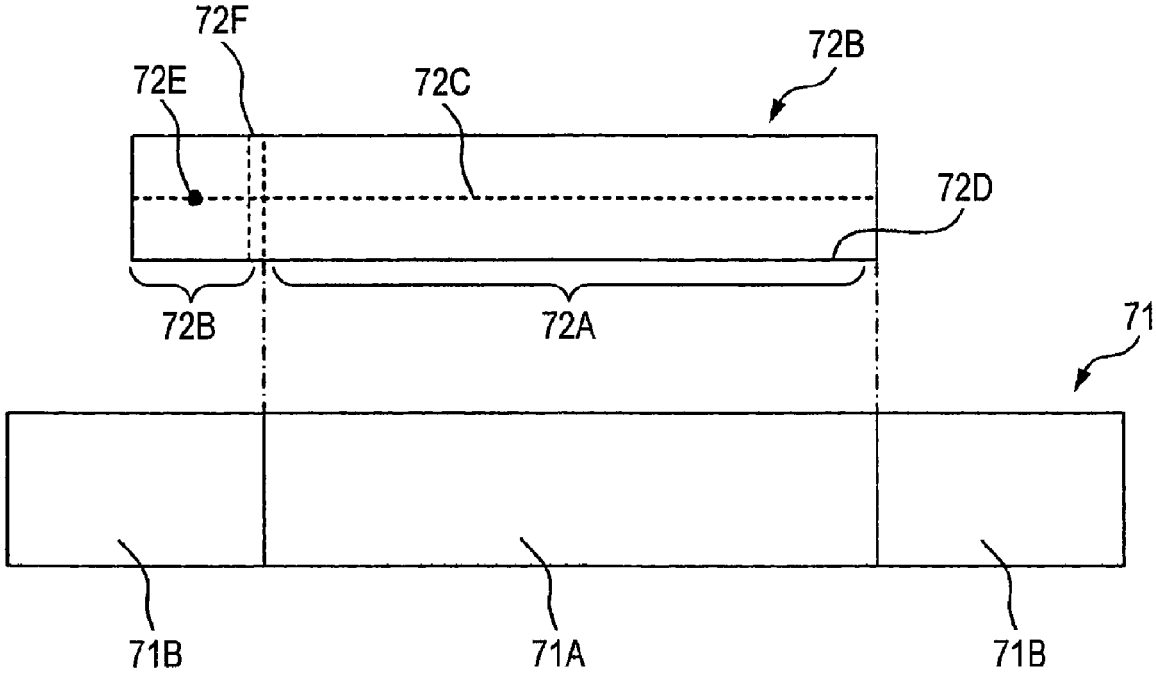
FIG. 3 is a view showing a photosensitive drum and the charger of FIG. 2 as seen from a forward upper side of the image forming apparatus.

Referring to FIG. 2 and FIG. 3, the charger 72 according to the first exemplary embodiment of the present invention is a charger of a scorotron type which comprises a charging wire 72C and a grid electrode 72D. The charging wire 72C is extended in a parallel direction with an axial direction of the photosensitive drum 71 from a first space 72A corresponding to an image forming region 71A in which an electrostatic latent image is formed in the photosensitive drum 71 to a second space 72B corresponding to a non-image forming region 71B on the outside of the image forming region 71A in the axial direction of the photosensitive drum 71. The charging wire 72C according to the first exemplary embodiment of the present invention is formed of tungsten.

Moreover, the grid electrode 72D comprises a conductive material which is disposed on the photosensitive drum 71 side at an interval (which may be predetermined) from the charging wire 72C and is extended in a parallel direction with the charging wire 72C, and is provided with a rectangular slit extended in the parallel direction with the axial direction of the photosensitive drum 71. The rectangular slit is provided in a part positioned on the first space 72A in the grid electrode 72D.

Potentials of the charging wire 72C and the grid electrode 72D are controlled to control a corona discharge from the charging wire 72C so that a positive charge is applied to the surface of the photosensitive drum 71 substantially uniformly.

In addition to the charging wire 72C and the grid electrode 72D, a leakage promoting portion 72E for generating a leakage in the second space 72B more easily than the first space 72A is provided on one end side in the axial direction of the charger 72. The leakage promoting portion 72E serves to easily generate the leakage by setting an electrical insulating distance between the charging wire 72C and the grid electrode 72D to be smaller than that in the other portions.

More specifically, in the first exemplary embodiment of the present invention, the leakage promoting portion 72E comprises a disk-shaped conductive member that is bonded to the charging wire 72C to protrude a portion integrated electrically with the charging wire 72C from the charging wire 72C toward the grid electrode 72D side.

Moreover, a partitioning member 72F takes a shape of a plate which serves to partition a space in which the charging wire 72C is provided in the charger 72 into the first space 72A and the second space 72B. By the partitioning member 72F, it is possible to prevent the toner or dust flowing into the first space 72A from the slit provided on the grid electrode 72D from flowing into the second space 72B.

The partitioning member 72F is movable in a longitudinal direction of the charging wire 72C and has a plate surface provided with an inserting hole 72G for inserting the charging wire 72C therein and sliding the charging wire 72C in a movement. When the partitioning member 72F is moved in the longitudinal direction of the charging wire 72C, therefore, the dust stuck to the charging wire 72C is rubbed off through the inserting hole 72G so that the charging wire 72C is cleaned.

In the first exemplary embodiment of the present invention, the charging wire 72C is cleaned by the movement of the partitioning member 72F through a manual operation. In the case in which a leakage current is detected in the leakage promoting portion 72E as will be described below, therefore, an alarm such as a message to promote the execution of a cleaning work is provided.

2. 3. 5. Outline of Image Forming Operation

In the image forming portion 10, an image is formed on a sheet in the following manner.

A corona discharge is generated from the charging wire 72C of the charger 72 so that the surface of the photosensitive drum 71 is positively charged uniformly with a rotation thereof. Then, the surface of the photosensitive drum 71 is exposed through a high speed scan of a laser beam irradiated from the scanner portion 60. Consequently, an electrostatic latent image corresponding to an image to be formed on a sheet is formed on the surface of the photosensitive drum 71.

When the toner carried on the developing roller 74C and charged positively comes in contact with the photosensitive drum 71 opposite thereto by a rotation of the developing roller 74C, subsequently, it is supplied to the electrostatic latent image formed on the surface of the photosensitive drum 71, that is, an exposed portion in the surface of the photosensitive drum 71 charged uniformly and positively which is exposed by a laser beam and has a potential reduced. Consequently, the electrostatic latent image of the photosensitive drum 71 is changed into a visible image so that a toner image formed by a reversal development is carried on the surface of the photosensitive drum 71.

Thereafter, the toner image carried on the surface of the photosensitive drum 71 is transferred onto the sheet through a transfer bias applied to the transfer roller 73. The sheet to which the toner image is transferred is conveyed to the fixing unit 80 and is thus heated, and the toner transferred as a toner image is fixed onto the sheet so that the image formation is completed.

2. 4. Electrical Structure of the Image Forming Apparatus

Figure 4:
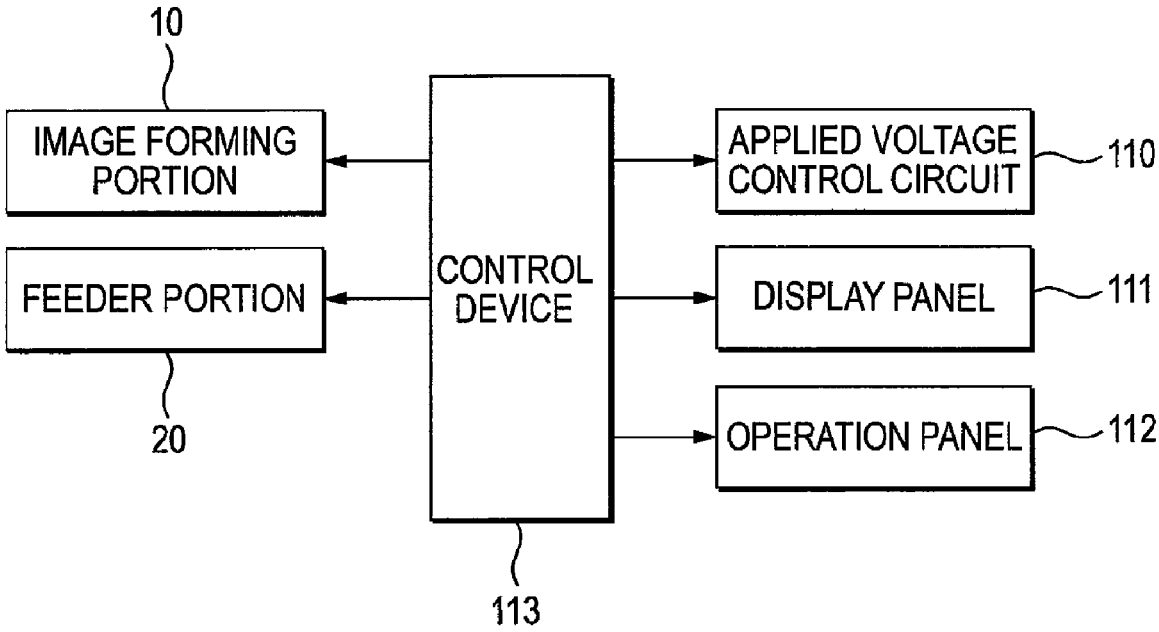
FIG. 4 is a block diagram schematically showing an electrical structure of the image forming apparatus according to the first exemplary embodiment of the present invention.

FIG. 4 is a block diagram schematically showing an electrical structure of the image forming apparatus according to the first exemplary embodiment of the present invention. An applied voltage control circuit 110 serves to control a voltage to be applied to the charger 72 (more specifically, the charging wire 72C and the grid electrode 72D) or the transfer roller 73. The applied voltage control circuit 110 according to the first exemplary embodiment of the present invention controls an applied voltage through a pulse width modulation (PWM) control.

Moreover, a display panel 111 serves as a means for displaying a notice of various information, and an operation panel 112 serves as a means for setting or operating the image forming device 1.

A control device 113 comprises a microcomputer including a random access memory (RAM), a read only memory (ROM) and a central processing unit (CPU). The control device 113 serves to control operations of the applied voltage control circuit 110 and the image forming portion 10 in accordance with a program which is prestored in a storing means such as the ROM.

3. Operation of Image Forming Apparatus According to the First Exemplary Embodiment

3. 1. Summary of Operation

In the first exemplary embodiment of the present invention, a leakage current generated with the progress of the wire thickening phenomenon is detected in an early stage before the generation of a leakage which adversely influences an electrostatic latent image, permitting a notice requesting cleaning of the charging wire 72C to be generated.

More specifically, the charging wire 72C of the second space 72B is provided with the leakage promoting portion 72E. In the first exemplary embodiment of the present invention, therefore, there is a high possibility that the leakage might be generated in the second space 72B in an earlier stage than the first space 72A.

Therefore, whether the leakage is generated in the second space 72B is decided by detecting the leakage current through the applied voltage control circuit 110 for controlling a voltage to be applied to the charging wire 72C and the grid electrode 72D. If the leakage current is detected in the second space 72B, this means that the wire thickening phenomenon is progressing to a state in which a leakage phenomenon will adversely influence the electrostatic latent image in the first space 72A, and a notification that the charging wire 72C should be cleaned is then provided.

When the leakage current from the charging wire 72C to the grid electrode 72D is generated, a breakdown is caused so that a potential difference between the charging wire 72C and the grid electrode 72D is reduced (theoretically, to zero). In the first exemplary embodiment, therefore, it is decided whether the leakage is generated or not based on a change in a feedback current for controlling the charger 72.

3. 2. Explanation of Operation

3. 2. 1. Main Control Flow

The operation of the image forming apparatus according to the first exemplary embodiment will be described in more detail below with reference to FIGS. 5 to 7.

Figure 5:
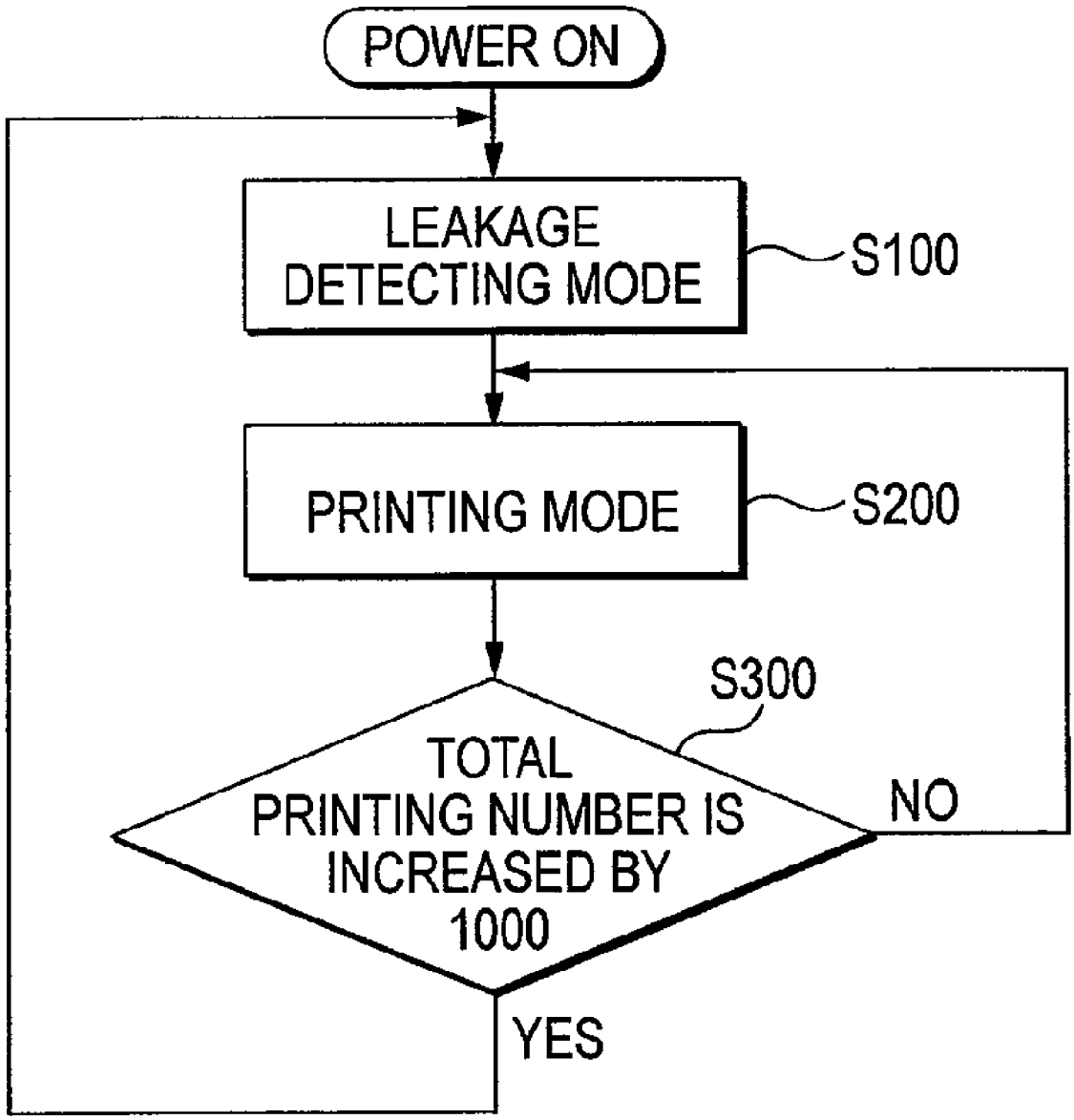
FIG. 5 is a flowchart showing an operation of the image forming apparatus according to the first exemplary embodiment of the present invention.

A control process shown in FIG. 5 is started when a power supply of the image forming apparatus 1 is turned ON and is ended when the power supply is turned OFF.

When the control process shown in FIG. 5 is started, a leakage detecting mode is executed at operation S100. When the leakage detecting mode is ended, a printing mode capable of executing a print processing (an image formation processing) is executed at operation S200. The leakage detecting mode serves to execute the operations summarized above in the "Summary of Operation" section. The details of the leakage detecting mode will be described in more detail below.

It is determined whether a total number of printed sheets exceeds a threshold number of sheets (e.g., 1000 in the first exemplary embodiment) or not at operation S300. If it is determined that the total number of printed sheets does not exceed the threshold number of sheets (S300: NO), the process returns to operation S200 and the printing mode is executed again. On the other hand, if it is determined that the total number of printed sheets exceeds the threshold number of sheets (S300: YES), a counting means for counting the number of printed sheets is initialized to be zero and processing returns to operation S100 and the leakage detecting mode is executed again.

As described above, in the first exemplary embodiment, the leakage detecting mode is executed every time the image forming apparatus 1 is started and each time the number of printed sheets exceeds the threshold number of sheets.

3. 2. 2. Leakage Detecting Mode at Startup (see FIG. 6)

Figure 6:
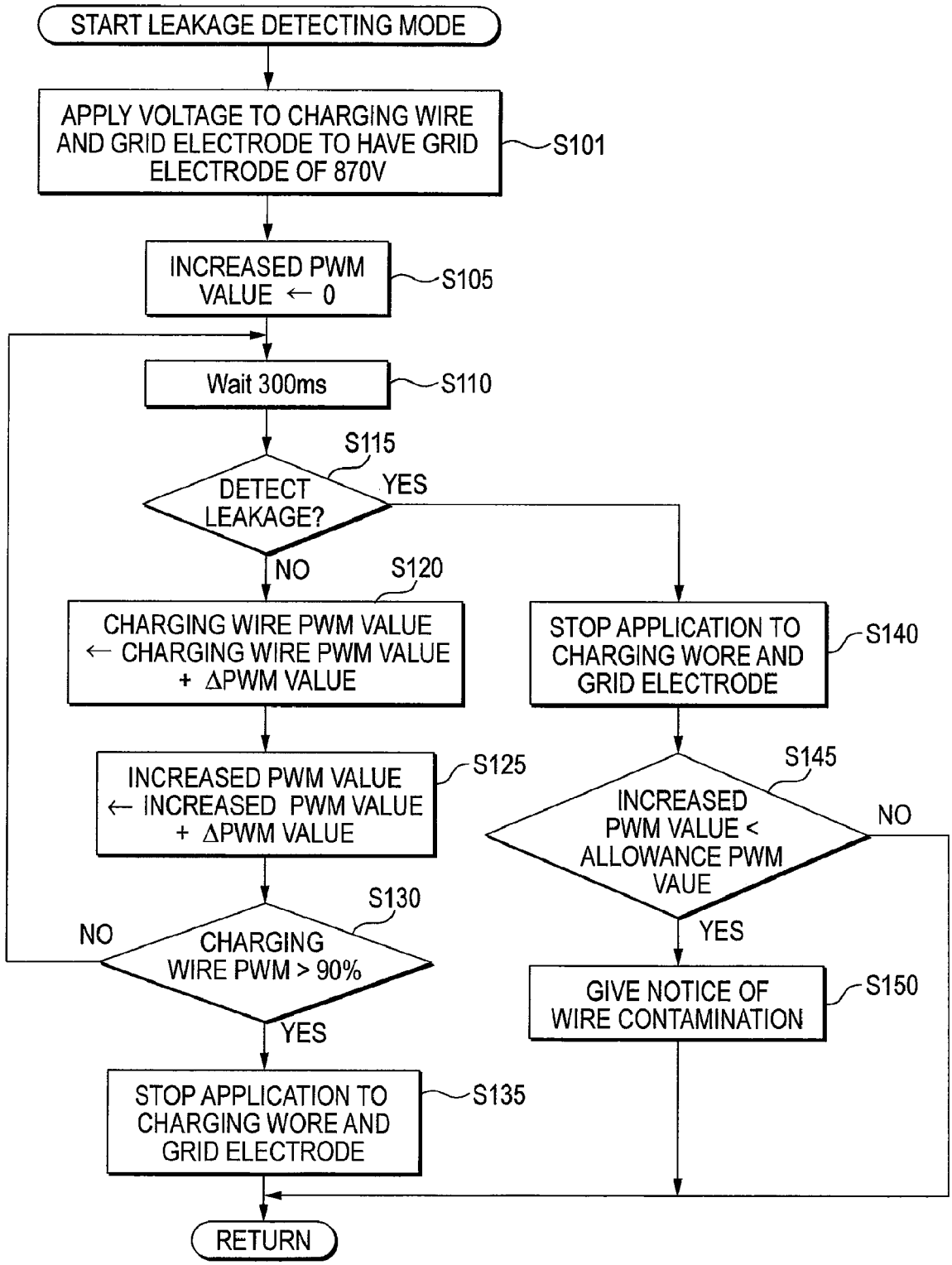
FIG. 6 is a flowchart showing details of a leakage detecting mode according to the first exemplary embodiment of the present invention.

FIG. 6 is a flowchart showing details of the leakage detecting mode according to the first exemplary embodiment of the present invention. When the control is started, the voltage to be applied to the charging wire 72C and the grid electrode 72D is controlled in such a manner that the potential of the grid electrode 72D is set to be a threshold voltage (for example, 870V) at operation S101, and an initial value (e.g., 0) is then input to a parameter for controlling the applied voltage (which will be herein after referred to as a pulse width modulation (PWM) value) at operation S105.

After the initial PWM value is set, the process then waits for a threshold time to pass (for example, 300 milliseconds) at operation S110, and it is determined whether a leakage current is detected or not at operation S115. If it is determined that the leakage current is not detected (S115 NO), a value obtained by adding a PWM value in a incremental amount (a ΔPWM value) to the PWM value for controlling the current charging wire 72C is input as a next PWM value for controlling the voltage to be applied to the charging wire 72C at operation S120. Furthermore, the ΔPWM value is added to the increased ΔPWM value indicative of an integrated value of the ΔPWM value which is sequentially added up to a present time and the increased PWM value is thus updated at operation S125.

It is decided whether the PWM value for controlling the charging wire 72C which was updated in operation S120 exceeds a threshold value (for example, 90%) or not at operation S130. If it is determined that the PWM value exceeds the threshold value (S130: YES), a possibility of the generation of a leakage is regarded to be low and the application of the voltage to the charging wire 72C and the grid electrode 72D is stopped at operation S135 and the process ends.

If it is determined that the PWM value does not exceed the threshold value (S130: NO), the process returns to operation S110 and it is again determined whether the leakage current is detected.

If it is determined that the leakage current is detected (S115: YES), the application of the voltage to the charging wire 72C and the grid electrode 72D is stopped at operation S140, and it is determined whether the current increased PWM value is smaller than an allowable PWM value at operation S145.

The allowable PWM value indicates an increased PWM value which is allowed up to the generation of the leakage. If the increased PWM value is greater than the allowable PWM value, it is decided that the wire thickening phenomenon does not matter.

If it is determined that the current increased PWM value is smaller than the allowable PWM value (S145: YES), an alarm indicating that the charging wire 72C should be cleaned or exchanged is displayed at operation S150, and the process ends.

3. 2. 3. Leakage Detecting Mode at Printing (see FIG. 7)

Figure 7:
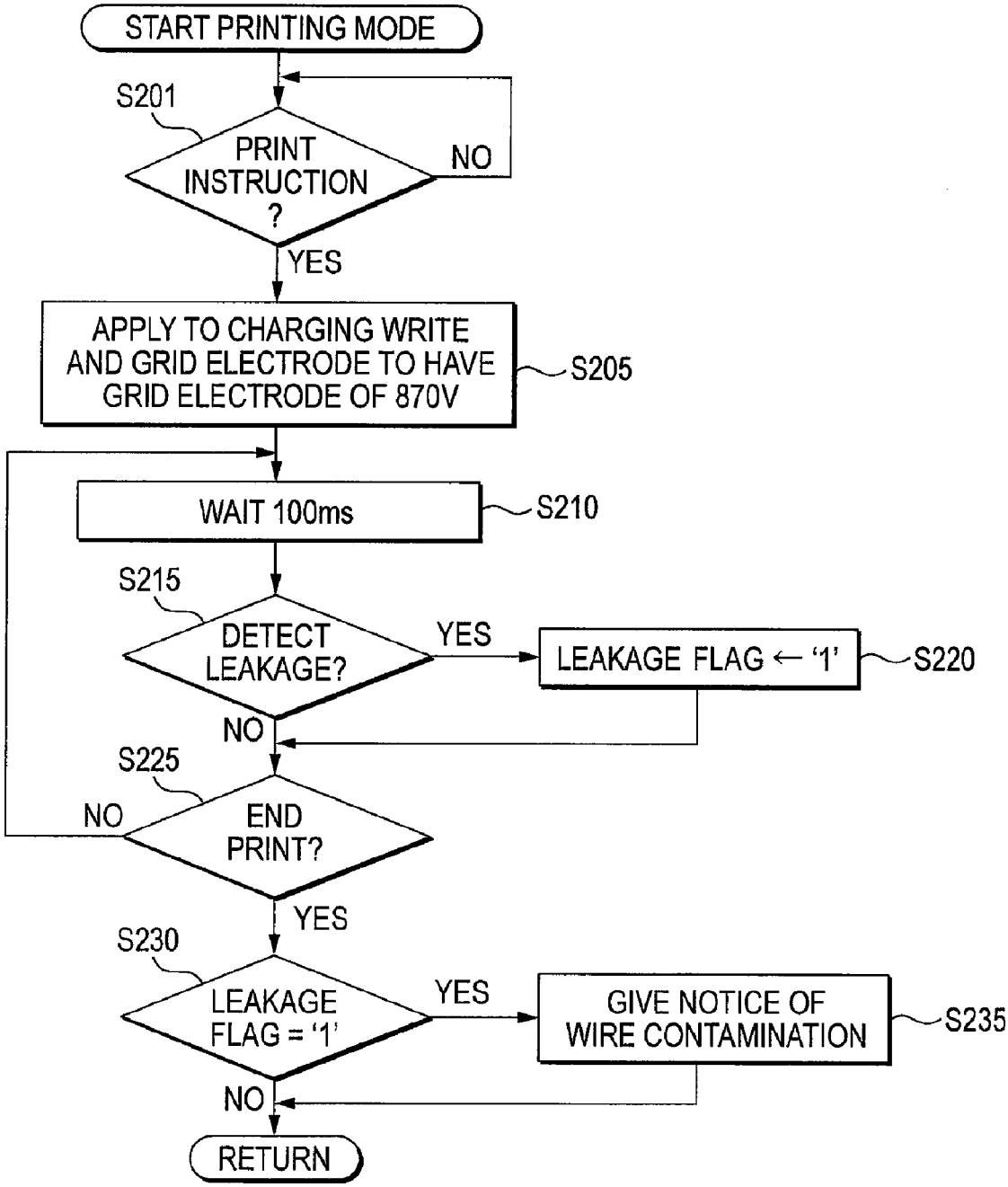
FIG. 7 is a flowchart showing details of a printing mode according to the first exemplary embodiment of the present invention.

FIG. 7 is a flowchart showing details of leakage detecting mode at printing. The process determines whether a leakage is generated together with the print processing when a driving operation of the charger 72 is controlled by the applied voltage control circuit 110 in the execution of print processing (i.e., the image formation processing).

More specifically, it is determined whether the image forming apparatus 1 has received a printing command at operation S201. If it is determined that the printing command has been received (S201: YES), the voltage to be applied to the charging wire 72C and the grid electrode 72D is controlled in such a manner that the potential of the grid electrode 72D is set to a threshold voltage (for example, 870V) at operation S205. After setting the voltage to be applied to the charging wire 72C and the grid electrode 72D to a threshold voltage, the process waits for an amount of time (for example, 100 milliseconds) to pass at operation S210 or waits while the print processing is being executed. It is then determined whether the leakage current is detected or not at operation S215 every time a threshold time (for example, 100 milliseconds) passes (S210).

If it is determined that the leakage current is detected (S215: YES), a leakage flag indicating that the leakage is generated is set into the storing device such as the RAM in the control device 113 at operation S220, and it is determined whether the print is ended or not at operation S225.

On the other hand, if it is determined that the leakage current is not detected (S215: NO), it is determined whether printing is ended or not at operation S225. If it is determined that the printing is ended (S225: YES), it is determined whether the leakage flag is set or not at operation S230. If it is decided that the printing is not ended (S225: NO), the process returns to operation S210 where the process waits for an amount of time and it is determined again whether the leakage current is detected or not at operation S215.

If it is determined that the leakage flag is set (S230 YES), an alarm indicating that the charging wire 72C should be cleaned or exchanged is displayed at operation S235 and the process ends. On the other hand, if it is determined that the leakage flag is not set (S230: NO), the process ends.

According to the first exemplary embodiment of the present invention, consequently, when the leakage current is generated by the promoting unit, the charging wire is at least cleaned or exchanged. Therefore, it is possible to prevent wire thickening from progressing. Consequently, it is possible to suppress a leakage which adversely influences the electrostatic latent image formed on the photosensitive member. Moreover, the promoting unit is provided in the place other than the opposed position to the image forming region in which the electrostatic latent image is formed. Therefore, it is possible to prevent the leakage current generated by the promoting unit from adversely influencing the electrostatic latent image.

4. Feature of Image Forming Apparatus According to the First Exemplary Embodiment In the first exemplary embodiment of the present invention, the leakage generated from the leakage promoting portion 72E is detected so that the alarm indicating that the charging wire 72C should be cleaned or exchanged is generated. Before the generation of the leakage which adversely influences the electrostatic latent image formed on the photosensitive drum 71, therefore, it is possible to indicate that the charging wire 72C should be cleaned or exchanged.

If the charging wire 72C is cleaned or exchanged for a new charging wire 72C, moreover, it is possible to prevent the progress of the wire thickening. Therefore, it is possible to suppress the leakage which adversely influences the electrostatic latent image formed on the photosensitive drum 71.

The second space 72B is provided in the non-image forming region 71B. Therefore, there is a low possibility that the electrostatic latent image might be adversely influenced even if the leakage is generated through the leakage promoting portion 72E in the second space 72B.

In the first exemplary embodiment, moreover, the leakage promoting portion 72E is provided on only one end side in the axial direction of the charging wire 72C. As compared with the case in which the leakage promoting portion 72E is provided on both end sides in the axial direction of the charging wire 72C (the charger 72), therefore, it is possible to simplify the structure of the image forming apparatus 1.

In the first exemplary embodiment, moreover, there is provided the partitioning member 72F for partitioning the portion provided with the leakage promoting portion 72E in the charger 72 (the second space 72B) from the surroundings including the opposed portion (the first space 72A) to the image forming region 71A in the charger 72. In the charging wire 72C on the leakage promoting portion 72E side (the second space 72B), therefore, it is possible to prevent the wire thickening phenomenon from being generated.

Accordingly, it is possible to prevent the detection of the generation of the leakage in an unnecessarily early stage in the leakage promoting portion 72E, resulting in the alarm displayed on the display panel 111 or the cleaning or exchanging work for the charging wire 72C in the unnecessarily early stage irrespective of the fact that the charging wire 72C does not need to be cleaned or exchanged actually.

In the first exemplary embodiment, the partitioning member 72F is provided with the inserting hole 72G serving as the cleaning means. Therefore, it is not necessary to provide the cleaning means separately and it is possible to prevent an increase in the number of the components and the assembly man-hour of the image forming apparatus 1 while suppressing the adverse influence on the electrostatic latent image due to the leakage generated on the leakage promoting portion 72E side.

Second Exemplary Embodiment

Although the partitioning member 72F is provided with the inserting hole 72G serving as the cleaning means in the first exemplary embodiment, a charging wire exchanging mechanism 130 for exchanging the charging wire 72C is provided in addition to the cleaning means in a second exemplary embodiment of the present invention.

Figure 8:
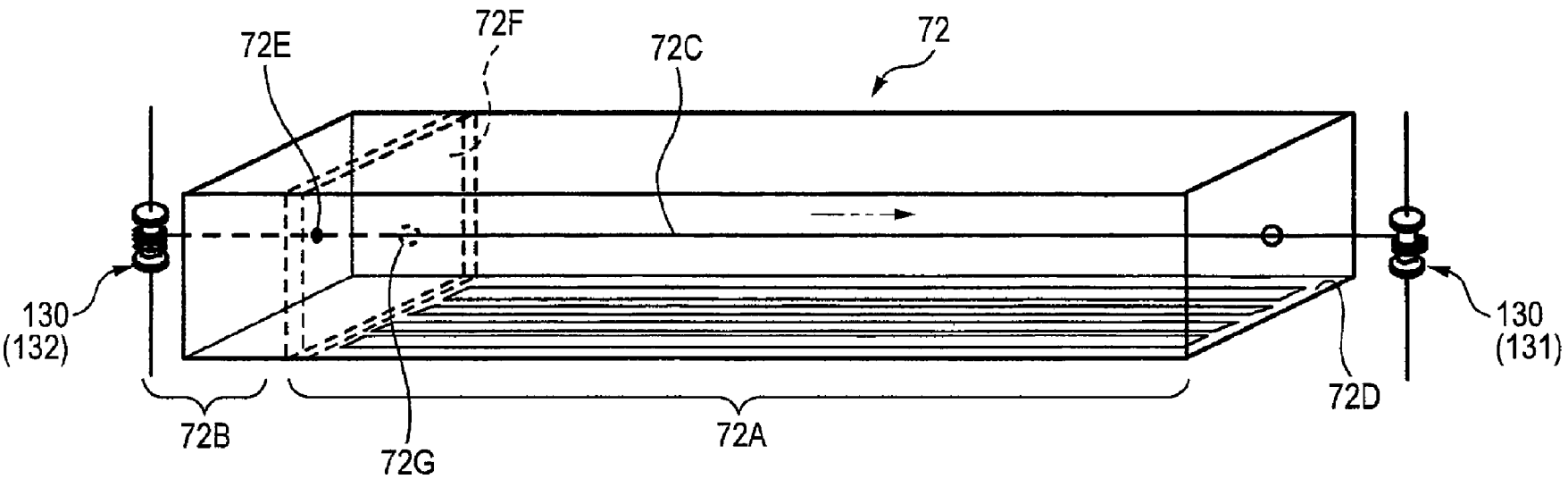
FIG. 8 is a view showing a charger according to a second exemplary embodiment of the present invention.

FIG. 8 is a view showing a charger 72 according to the second exemplary embodiment of the present invention. The charging wire exchanging mechanism 130 comprises a first wire winding portion 131 provided on one end side in a longitudinal direction of the charging wire 72C and a second wire winding portion 132 provided on the other end side in the longitudinal direction thereof.

When the first wire winding portion 131 is rotated to wind the old charging wire 72C through the first wire winding portion 131, a new charging wire 72C is conveyed from the second wire winding portion 132 toward a first space 72A side interlockingly therewith. Thus, the charging wire 72C can be exchanged.

When a leakage is detected and an alarm indicating that the charging wire 72C should be exchanged is given in a leakage detecting mode at startup or a leakage detecting mode at printing (see operations S150 and S235 of FIGS. 6 and 7, respectively), the progress of wire thickening can be prevented by exchanging the charging wire 72C. Therefore, it is possible to suppress a leakage which adversely influences an electrostatic latent image formed on a photosensitive drum 71.

In the second exemplary embodiment of the present invention, the cleaning means (the inserting hole 72G) is also provided. Therefore, the charging wire 72C may also be cleaned in the same manner as in the first exemplary embodiment when the alarm is generated.

According to the second aspect of the invention, consequently, there is given the alarm indicative of the purport that the charging wire is to be cleaned or exchanged. Before a leakage which adversely influences the electrostatic latent image formed on the photosensitive member is generated, therefore, it is possible to give a user the purport that the charging wire is to be cleaned or exchanged. If the charging wire is at least cleaned or exchanged by the user, moreover, it is possible to prevent the wire thickening from progressing. Therefore, it is possible to suppress the leakage which adversely influences the electrostatic latent image formed on the photosensitive member. Furthermore, the promoting unit is provided in the place other than the opposed position to the image forming region in which the electrostatic latent image is formed. Consequently, it is possible to prevent the leakage current generated by the promoting unit from adversely influencing the electrostatic latent image.

Third Exemplary Embodiment

Figure 9:
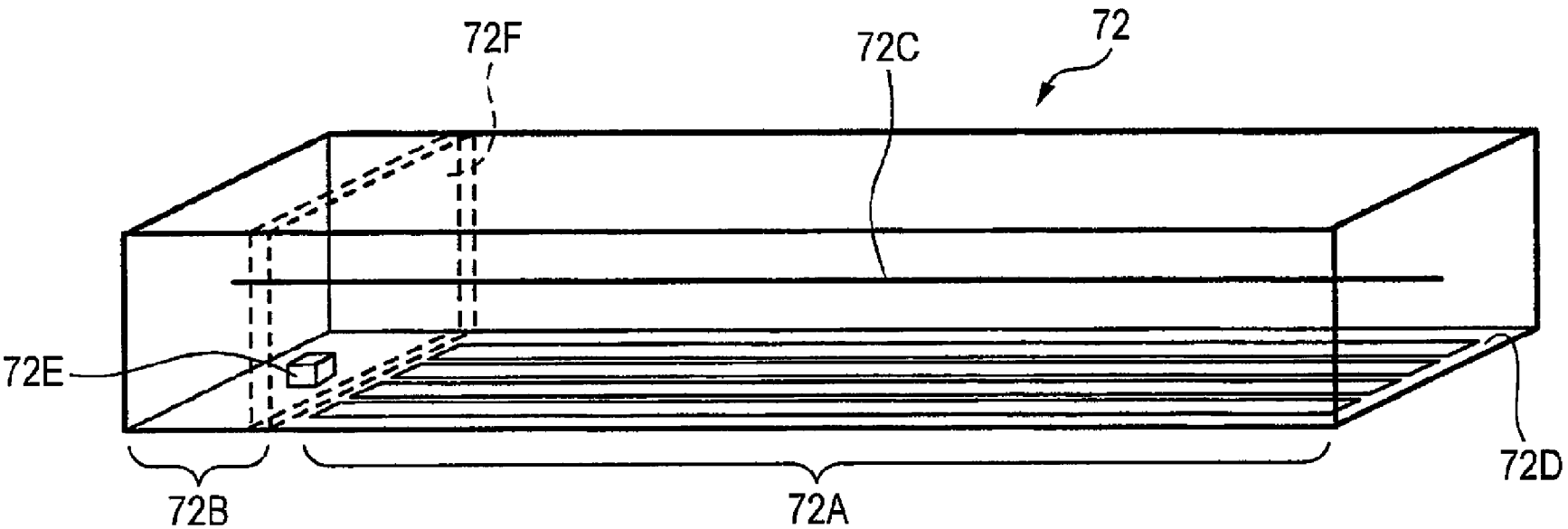
FIG. 9 is a view showing a charger according to a third exemplary embodiment of the present invention.
Figure 10:
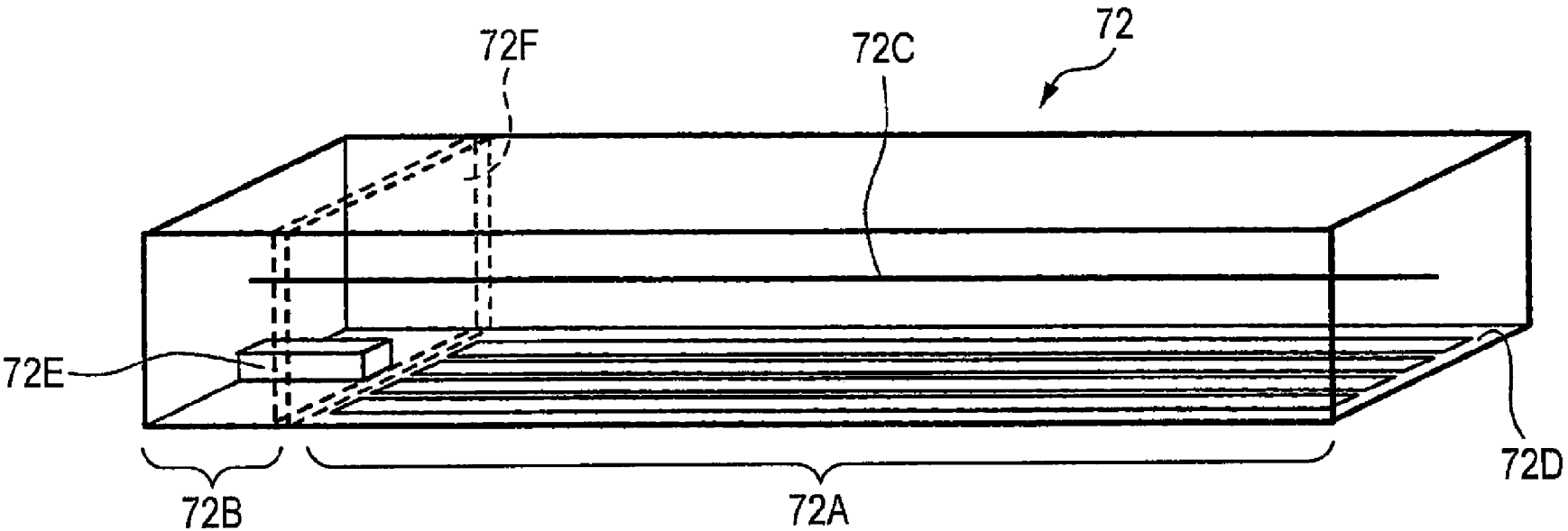
FIG. 10 is a view showing the charger according to the third exemplary embodiment of the present invention.
Figure 11:
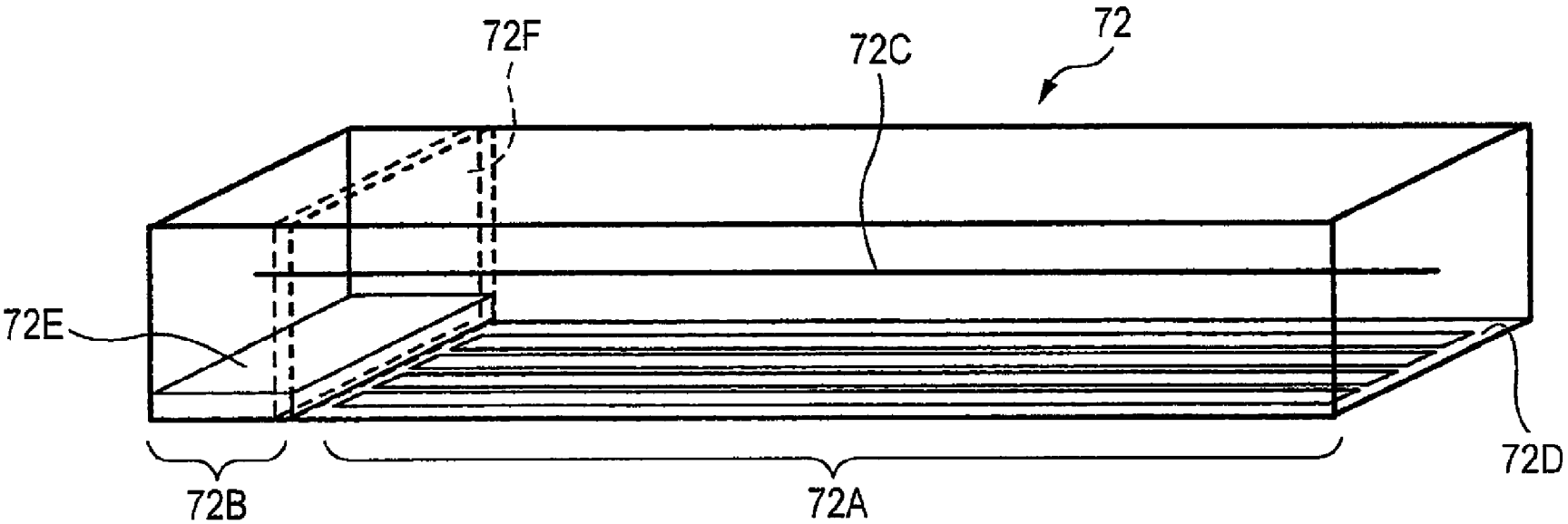
FIG. 11 is a view showing the charger according to the third exemplary embodiment of the present invention.

In the first and second exemplary embodiments, the protruded leakage promoting portion 72E is provided on the charging wire 72C to easily generate the leakage phenomenon in the second space 72B. However, in a third exemplary embodiment of the present invention, a leakage promoting portion 72E comprises a member protruded from a grid electrode 72D toward a charging wire 72C side as shown in FIGS. 9 to 11.

The member protruded from the grid electrode 72D may have different configurations. FIGS. 9 and 10 show examples in which the leakage promoting portion 72E constituted by a conductive material is bonded to the grid electrode 72D, and FIG. 11 shows an example in which a whole region at the second space 72B side in the grid electrode 72D is protruded toward the charging wire 72C side.

The member protruded from the grid electrode 72D toward the charging wire 72C side, reduces the amount of labor used compared with the case in which the leakage promoting portion 72E is provided on the charging wire 72C which is not a plane.

In the case in which the charging wire 72C is exchanged by a charging wire exchanging mechanism 130, it is also advantageous to newly provide the leakage promoting portion 72E in the charging wire 72C positioned in a charger 72. As in the above exemplary embodiments, however, it is advantageous that the leakage promoting portion 72E should be provided on the grid electrode 72D. Thus, it is possible to reduce labor and a cost.

In the second exemplary embodiment and the third exemplary embodiment of the present invention, it is advantageous to provide at least one cleaning unit for cleaning the charging wire and at least one exchanging unit for exchanging the charging wire.

Fourth Exemplary Embodiment

Although in the first through third exemplary embodiments, the work for cleaning or exchanging the charging wire 72C is carried out manually, the work is automatically performed in a fourth exemplary embodiment.

Figure 12:
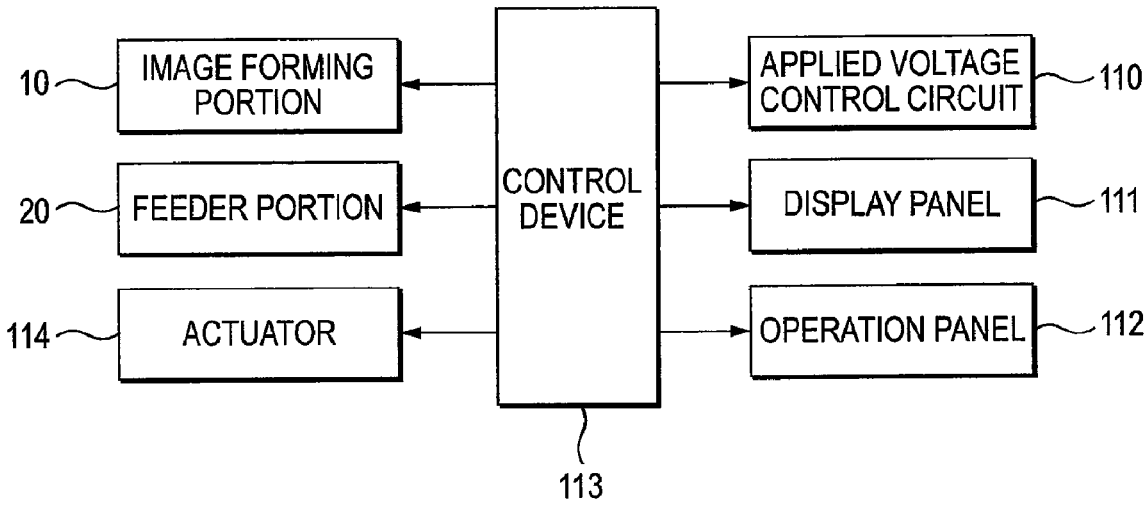
FIG. 12 is a block diagram schematically showing an electrical structure of image forming apparatus according to a fourth exemplary embodiment of the invention.

More specifically, FIG. 12 is a block diagram schematically showing an electrical structure of an image forming apparatus according to the fourth exemplary embodiment of the present invention. As shown in FIG. 12, there is provided an actuator 114 for driving a partitioning member 72F or a charging wire exchanging mechanism 130 if a leakage is detected in a leakage detecting mode at startup or at printing.

If a leakage generated from a leakage promoting portion 72E is detected, a charging wire 72C is automatically cleaned or exchanged. Therefore, it is possible to prevent the generation of a leakage which adversely influences an electrostatic latent image formed on a photosensitive drum 71.

Other Embodiments

A fifth exemplary embodiment of the present invention is characterized in that the promoting unit is provided on only one end side in the axial direction of the photosensitive member.

According to the fifth exemplary embodiment, the structure of the image forming apparatus can be simplified more as compared with the case in which the promoting unit is provided on both end sides in the axial direction of the photosensitive member.

While the photosensitive drum 71 is employed as a photosensitive member in the above exemplary embodiments, the invention is not restricted thereto. Rather, according to a sixth exemplary embodiment, a belt-like photosensitive member may be employed. In this case, an axial direction of the photosensitive member is coincident with that of a driving roller of a belt.

In the above exemplary embodiments, the image forming apparatus may be a laser printer. However, the image forming apparatus is not limited to a color laser printer of a direct tandem type.

While the applied voltage is controlled using PWM control in the above exemplary embodiments, the invention is not restricted thereto.

In the exemplary embodiments of the present invention, a plurality of leakage promoting portions 72E may be provided in the second space 72B.

In the exemplary embodiments of the present invention, the second space 72B may be provided on both end sides in the axial direction of the charger 72 and the leakage promoting portion 72E may be provided in each of the spaces on the end sides of the charger 72.

While there is provided the partitioning member 72F for partitioning the first space 72A and the second space 72B in the above exemplary embodiments of the present invention, the partitioning member 72F may be eliminated.

Furthermore, the leakage promoting portion 72E is not restricted to the structures described in the above exemplary embodiments. Rather it is possible to employ any specific structure as long as the structure generates the leakage phenomenon in the second space 72B more easily than in the first space 72A.

In addition, the leakage detecting method is not restricted to the above exemplary embodiments.

Moreover, the invention is not restricted to the above exemplary embodiments but various changes can be made without departing from the scope of the invention which has been described in the claims.

What is claimed is:

1. An image forming apparatus comprising:

a photosensitive member which carries an electrostatic latent image;

a charger comprising:

a charging wire extended in a direction parallel to an axial direction of the photosensitive member, the charger serving to charge the photosensitive member; and a promoting unit which is provided on at least one side of a region of the charger which is opposite to an image forming region in which the electrostatic latent image is formed, the promoting unit promoting a leakage current of the charger;

detecting unit which detects the leakage current of the charger; and a correction unit which corrects the charging wire if the leakage current is detected.

2. The image forming apparatus according to claim 1, wherein the correction unit is at least one of an exchanging unit and a cleaning unit, the cleaning unit for cleaning the charging wire if the leakage current is detected by the detecting unit, and the exchanging unit for exchanging the charging wire if the leakage current is detected by the detecting unit.

3. The image forming apparatus according to claim 1, wherein the promoting unit is provided on only one end side in the axial direction of the photosensitive member.

4. The image forming apparatus according to claim 1, wherein the charger further comprises a partitioning member which partitions a portion of the charger which is provided with the promoting unit from a remaining portion of the charger which is provided at a portion opposite to the image forming region.

5. The image forming apparatus according to claim 4, wherein the partitioning member comprises the cleaning unit, and the partitioning member is movable in a longitudinal direction of the charging wire.

6. The image forming apparatus according to claim 1, wherein the charger further comprises a grid electrode extended in a parallel direction with the charging wire, and the promoting unit comprises a member protruded from the grid electrode toward a side of the charging wire.

7. The image forming apparatus according to claim 1, wherein the detecting unit operates during a detecting mode for detecting the leakage current while changing a voltage to be applied to the charging wire.

8. An image forming apparatus comprising:

a photosensitive member which carries an electrostatic latent image;

a charger comprising:

a charging wire extended in a direction parallel to an axial direction of the photosensitive member, the charger serving to charge the photosensitive member; and a promoting unit which is provided on at least one side of a region of the charger which is opposite to an image forming region in which the electrostatic latent image is formed, the promoting unit promoting a leakage current of the charger;

detecting unit which detects the leakage current of the charger; and a notification unit which provides a notice to correct the charging wire if the leakage current is detected by the detecting unit.

9. The image forming apparatus according to claim 8, further comprising a correction unit, wherein the correction unit is at least one of an exchanging unit and a cleaning unit, the exchanging unit for exchanging the charging wire responsive to the notice and the cleaning unit for cleaning the charging wire responsive to the notice.

* * * * *